US009662885B2

(12) United States Patent
Shimazu et al.

(10) Patent No.: US 9,662,885 B2
(45) Date of Patent: May 30, 2017

(54) PROCESS FOR PRODUCING LIQUID EJECTION HEAD

(71) Applicant: CANON KABUSHIKI KAISHA, Tokyo (JP)

(72) Inventors: Satoshi Shimazu, Kawasaki (JP); Naoya Tsukamoto, Kawasaki (JP); Motoaki Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 14/224,424

(22) Filed: Mar. 25, 2014

(65) Prior Publication Data

US 2014/0292939 A1 Oct. 2, 2014

(30) Foreign Application Priority Data

Mar. 29, 2013 (JP) ..... 2013-071974

(51) Int. Cl.
*B21D 53/00* (2006.01)
*B41J 2/16* (2006.01)
*B41J 2/14* (2006.01)

(52) U.S. Cl.
CPC ..... *B41J 2/1623* (2013.01); *B41J 2/14072* (2013.01); *B41J 2/1601* (2013.01); *Y10T 29/49147* (2015.01)

(58) Field of Classification Search
CPC ..... B41J 2/1623
USPC ..... 29/890.1
See application file for complete search history.

(56) References Cited

U.S. PATENT DOCUMENTS

| | | | | |
|---|---|---|---|---|
| 5,808,641 | A * | 9/1998 | Miyagawa et al. | 347/65 |
| 5,953,023 | A | 9/1999 | Shimomura et al. | |
| 6,471,901 | B1 * | 10/2002 | Kawamura et al. | 264/267 |
| 7,171,748 | B2 | 2/2007 | Kigami et al. | |
| 7,547,094 | B2 * | 6/2009 | Kawamura et al. | 347/50 |
| 7,722,917 | B2 | 5/2010 | Shimomura et al. | |
| 7,732,228 | B2 | 6/2010 | Ono et al. | |
| 7,971,966 | B2 * | 7/2011 | Shimazu et al. | 347/50 |
| 7,984,549 | B2 * | 7/2011 | Osaki | 29/890.1 |
| 8,210,647 | B2 * | 7/2012 | Shimazu et al. | 347/44 |
| 8,342,655 | B2 * | 1/2013 | Otaka et al. | 347/50 |

(Continued)

FOREIGN PATENT DOCUMENTS

| | | |
|---|---|---|
| CN | 102458862 A | 5/2012 |
| EP | 0 661 157 A2 | 7/1995 |

(Continued)

OTHER PUBLICATIONS

Office Action in Chinese Patent Application No. 201410101831.8, dated Aug. 5, 2015.

*Primary Examiner* — Paul D Kim
(74) *Attorney, Agent, or Firm* — Fitzpatrick, Cella, Harper & Scinto

(57) ABSTRACT

A process for producing a liquid ejection head includes steps of providing an element substrate having an element for generating energy to be utilized for ejecting a liquid, a wiring substrate electrically connected to the element substrate through a lead wire, and a support member having a first support portion and a second support portion; applying a sealant to the second support portion; placing the element substrate on the first support portion and bringing the lead wire into contact with the sealant applied to the second support portion; and curing the sealant.

6 Claims, 7 Drawing Sheets

(56) References Cited

U.S. PATENT DOCUMENTS

| | | | | |
|---|---|---|---|---|
| 8,678,556 | B2 | 3/2014 | Iwanaga et al. | |
| 8,714,711 | B2 * | 5/2014 | Otaka et al. | 347/64 |
| 8,777,377 | B2 * | 7/2014 | Nagata et al. | 347/58 |
| 8,851,660 | B2 * | 10/2014 | Furukawa | 347/104 |
| 8,893,385 | B2 * | 11/2014 | Tsujiuchi et al. | 29/890.1 |
| 2004/0040152 | A1 | 3/2004 | Kigami et al. | |
| 2005/0104936 | A1 | 5/2005 | Conta et al. | |
| 2007/0006459 | A1 * | 1/2007 | Ono et al. | 29/890.1 |
| 2007/0285465 | A1 * | 12/2007 | Shibata et al. | 347/47 |

FOREIGN PATENT DOCUMENTS

| | | | |
|---|---|---|---|
| JP | 2001-130001 | A | 5/2001 |
| WO | 95/09085 | A1 | 4/1995 |

* cited by examiner

PROCESS FOR PRODUCING LIQUID EJECTION HEAD

BACKGROUND OF THE INVENTION

Field of the Invention

The present invention relates to a liquid ejection head and a production process thereof, and particularly to a liquid ejection head provided with a sealant covering a lead wire and a production process thereof.

Description of the Related Art

A liquid ejection head has been utilized for various office equipment such as a printer and a copying machine in recent years and is going to spread rapidly to an industrial system such as a textile printing apparatus. Examples of a form of the liquid ejection head include such a form that separately and detachably installs a liquid ejection portion and a liquid tank and such a cartridge form that a liquid ejection portion and a liquid container are integrally formed.

FIG. 6 is a perspective view of a relevant liquid ejection head. As illustrated in FIG. 6, a liquid ejection head 1 is provided with an element substrate 2, an electrical wiring substrate 3 electrically connected to the element substrate 2 through a lead wire and a support member 4 supporting the element substrate 2 and the electrical wiring substrate 3. The lead wire is covered with a sealant 5.

As a process for producing the liquid ejection head 1 illustrated in FIG. 6, a production process including a step of filling two different liquid fillers around the lead wire to cure the fillers is proposed (Japanese Patent Application Laid-Open No. 2001-130001). The two different fillers are cured, thereby forming the sealant 5 covering a joint portion.

The production process disclosed in Japanese Patent Application Laid-Open No. 2001-130001 is described in more detail with reference to FIGS. 7A to 7D. FIGS. 7A to 7D are drawings for explaining the production process disclosed in Japanese Patent Application Laid-Open No. 2001-130001 and enlarged sectional views taken along line 7-7 in FIG. 6 and illustrating the element substrate 2, the electrical wiring substrate 3 and the support member 4.

As illustrated in FIG. 7A, a worker or a production apparatus first applies a mount adhesive 6 for fixing the element substrate 2 and a TAB-sticking adhesive 7 for fixing the electrical wiring substrate 3 to the support member 4. The worker or the production apparatus also electrically connects the element substrate 2 to the electrical wiring substrate 3 through the lead wire 8.

As illustrated in FIG. 7B, the worker or the production apparatus then arranges the element substrate 2 and the electrical wiring element 3 on the support member 4. At this time, a filler reservoir portion 9 is formed around the element substrate 2, and the lead wire 8 is arranged over the filler reservoir portion 9. Thereafter, the worker or the production apparatus pours a first filler 10 into the filler reservoir portion 9.

The first filler 10 is a thermally curable resin such as an underfilling material for flip chip that is used in bare chip mounting. The viscosity of the underfilling material is about 50 poises at ordinary temperature, but is 15 poises or lower at 40° C. to 70° C. That is, the viscosity of the first filler 10 is relatively low in a state of 40° C. to 70° C., and so the flowability thereof is relatively high.

The temperature of the support member 4 is kept to a temperature of 40° C. to 70° C. when the first filler 10 is poured into the filler reservoir portion 9, whereby the first filler 10 is kept to such a state that the flowability thereof is relatively high. The support member 4 is left to stand for about 3 to 10 minutes at the temperature of 40° C. to 70° C., whereby the first filler 10 spreads all over the filler reservoir portion 9 to reach the lead wire 8 (see FIG. 7C).

Thereafter, the worker or the production apparatus applies a second filler 11 on to the first filler 10. The second filler 11 is a thermally curable resin that has almost the same composition as the first filler 10, but has a higher viscosity and lower flowability than the first filler 10. Accordingly, the second filler 11 rises on the first filler 10, and the lead wire 8 is covered with the first and second fillers 10 and 11. Heat is applied to the first and second fillers 10 and 11, whereby the first and second fillers 10 and 11 are cured to form the sealant 5 covering the lead wire 8 (see FIG. 6).

In order to further reduce the production cost of the liquid ejection head, it is required to shorten the production time of the liquid ejection head and to simplify the work upon the production of the liquid ejection head. However, it has been difficult for the production process disclosed in Japanese Patent Application Laid-Open No. 2001-130001 to shorten the production time and to simplify the work upon the production.

Specifically, when the leaving time of the support member 4 after the first filler 10 is poured into the filler reservoir 9 is insufficient in the production process disclosed in Japanese Patent Application Laid-Open No. 2001-130001, a bubble 12 may become mixed in the first filler 10 as illustrated in FIG. 8. The bubble 12 rapidly expands when the first and second fillers 10 and 11 are cured by heating. As a result, the first and second fillers 10 and 11 splash to expose the lead wire 8. For this reason, the support member 4 needs to be left to stand for about 3 to 10 minutes after the first filler 10 is poured into the filler reservoir 9 to prevent the bubble from being mixed in the first filler 10, so that it has been difficult to shorten the production time.

In addition, the production process disclosed in Japanese Patent Application Laid-Open No. 2001-130001 has to use the two different fillers 10 and 11. Accordingly, the management of materials upon the production of the liquid ejection head is complicated, so that it has been difficult to simplify the work upon the production of the liquid ejection head.

SUMMARY OF THE INVENTION

In order to solve the above problems, the present invention provides a process for producing a liquid ejection head, including the following steps:

providing an element substrate provided with an element for generating energy to be utilized for ejecting a liquid, a wiring substrate electrically connected to the element substrate through a lead wire, and a support member provided with a first support portion and a second support portion;

applying a sealant to the second support portion;

placing the element substrate on the first support portion and bringing the lead wire into contact with the sealant applied to the second support portion; and curing the sealant.

In order to solve the above problems, the present invention also provides a liquid ejection head including:

an element substrate provided with an element for generating energy to be utilized for ejecting a liquid;

a wiring substrate electrically connected to the element substrate through a lead wire and provided with a wiring for transmitting an electrical signal for driving the element substrate;

a sealant for sealing an electrically connected portion between the lead wire and the element substrate; and a support member provided with a first support portion supporting the element substrate and a second support portion to which the sealant is applied, wherein the second support portion is formed on a top surface of a projected portion, and a space portion to which the sealant is not applied is formed between the projected portion and the element substrate.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 6:
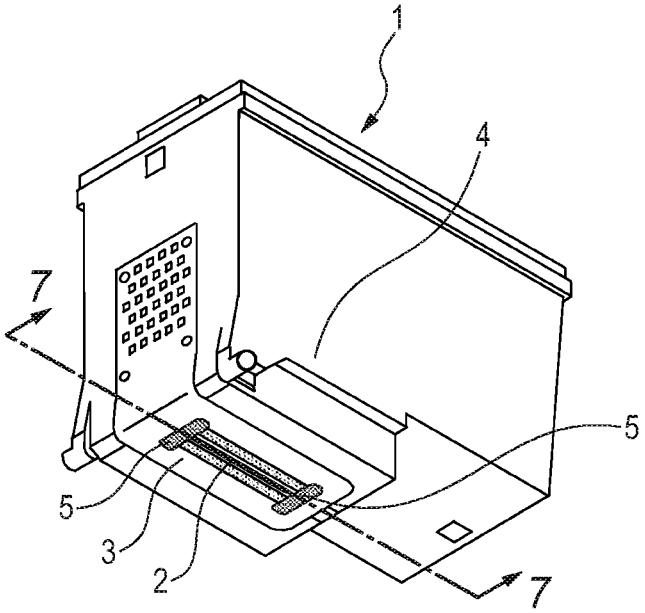
PRIOR ART FIG. 6
FIG. 6 is a perspective view of a relevant liquid ejection head.
Figure 7A:
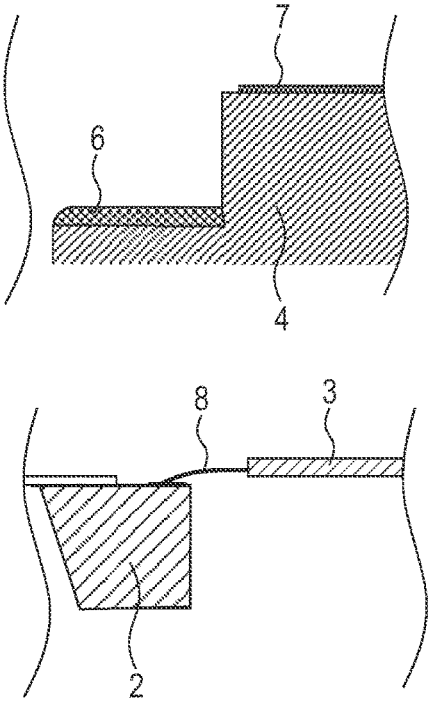
FIG. 7A PRIOR ART
FIGS. 7A, 7B, 7C and 7D are sectional views for explaining a conventional production process.
Figure 7B:
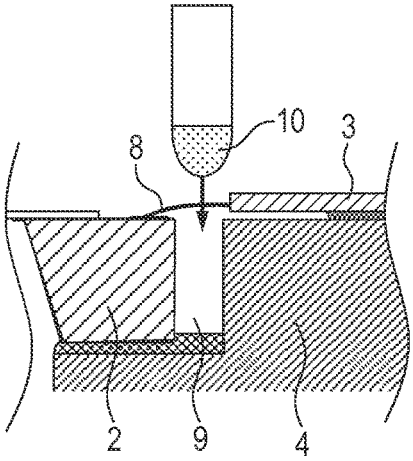
FIG. 7B PRIOR ART
Figure 7C:
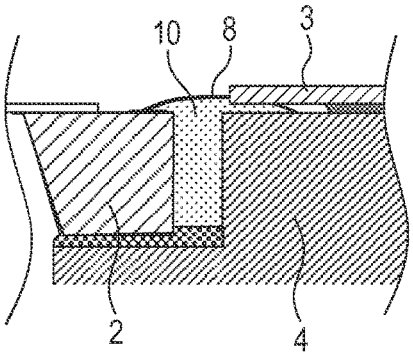
FIG. 7C PRIOR ART
Figure 7D:
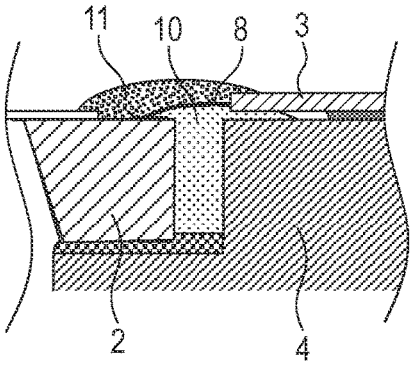
FIG. 7D PRIOR ART
Figure 8:
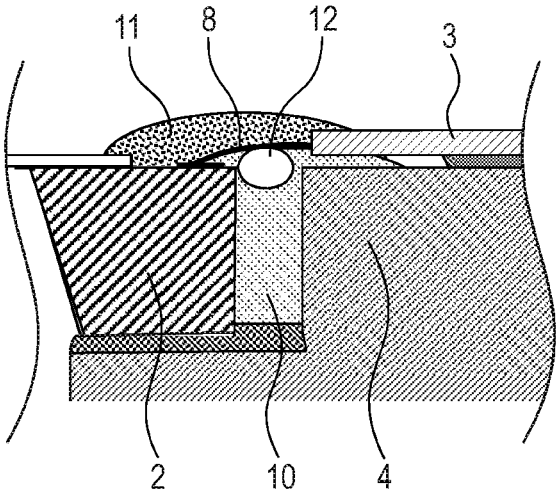
PRIOR ART FIG. 8
FIG. 8 is a sectional view for explaining a state of a bubble having been mixed in a first filler.

Outlines of a liquid ejection head for ejecting a liquid such as an ink according to an embodiment of the present invention and a production process thereof are described with reference to FIGS. 1A and 1B. Incidentally, the same signs are given to the same constituent elements as the constituent elements illustrated in FIG. 6 or FIG. 8.

The structure of the liquid ejection head is first described. FIGS. 1A and 1B are an exploded perspective view of a liquid ejection head to which the present invention can be applied and a perspective view of an external appearance thereof. As illustrated in FIGS. 1A and 1B, the liquid ejection head 1 is provided with an element substrate 2, an electrical wiring substrate 3 and a support member 4.

The element substrate 2 includes a silicon substrate having a thickness of 0.6 mm or more and 0.8 mm or less, a plurality of electrothermal converters arranged on one surface of the silicon substrate (hereinafter, the surface of the silicon substrate is referred to as "front surface") and electrical wirings electrically connected to the respective electrothermal converters. The electrical wirings supply electric power to the respective electrothermal converters, and the respective electrothermal converters apply ejection energy to a liquid such as an ink by using the electric power applied by the electrical wirings to eject the liquid. The electrical wirings are formed on the silicon substrate by means of, for example, a film forming technology.

The element substrate 2 also includes a plurality of ejection orifices (hereinafter, "plurality of ejection orifices" is referred to also as "ejection orifice group") corresponding to the electrothermal converters, a plurality of liquid flow paths respectively communicating with the ejection orifices and a liquid supply path for supplying the liquid to the plurality of liquid flow paths. The liquid supply path is formed by a hole piercing between the front surface of the silicon substrate and a back surface opposing the front surface. The plurality of ejection orifices and the plurality of liquid flow paths are formed on the silicon substrate by a lithographic technology.

The electrical wiring substrate 3 is a member for applying an electric signal for ejecting the liquid to the element substrate 2 and has a plurality of lead wires 8 corresponding to a connection terminal 13 (see FIGS. 3A, 3B and 4A) arranged on the element substrate 2. Incidentally, the lead wires 8 may also be single.

The lead wire 8 is covered with a sealant 5. As the sealant 5, a thermally curable material or an ultraviolet curable material may be used.

The support member 4 supports the element substrate 2 and the electrical wiring substrate 3.

Figure 1A:
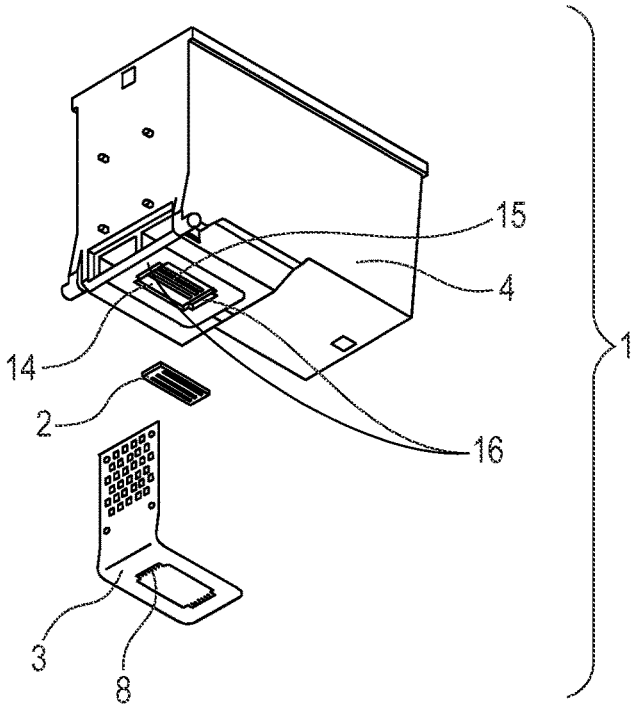
FIGS. 1A and 1B are an exploded perspective view of a liquid ejection head to which the present invention can be applied and a perspective view of an external appearance thereof.
Figure 1B:
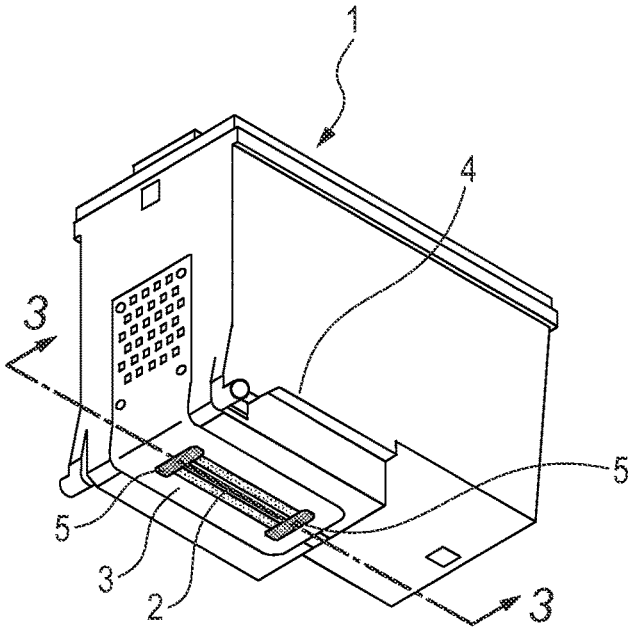

In the embodiment illustrated in FIGS. 1A and 1B, the support member 4 has a recessed portion 14, and the element substrate 2 is arranged on a bottom portion of the recessed portion 14. That is, the support member 4 supports the element substrate 2 on the bottom portion of the recessed portion 14. The lead wire 8 spans a space between the element substrate 2 and at least one side surface of the recessed portion 14.

In addition, the support member 4 has an element substrate support surface supporting the element substrate 2, i.e., an opening of the liquid flow path 15, in the bottom surface of the recessed portion 14. When the element substrate 2 is arranged on the bottom portion of the recessed portion 14, the liquid supply path of the element substrate 2 communicates with the liquid flow path 15.

Further, the support member 4 has a projected portion (second support portion) 16 provided protrudently in the above-described space from the bottom portion of the recessed portion 14. The projected portion 16 has a support surface supporting the sealant 5 from the side of the bottom portion of the recessed portion 14. The support surface is, for example, a tip surface (top surface) of the projected portion 16.

Outlines of a process for producing the liquid ejection head 1 according to the present invention are then described. The element substrate 2, the support member 4, the electrical wiring substrate 3 having the lead wire 8 and the sealant 5 before curing are first provided. The element substrate 2 and the electrical wiring substrate 3 are positioned within a range in which the connection terminal 13 (see FIGS. 3A, 3B and 4A) of the element substrate 2 can be connected to the lead wire 8 of the electrical wiring substrate 3. The element substrate 2 is then electrically connected to the electrical wiring substrate 3 through the lead wire 8 by a TAB technology.

A mount adhesive 6 is then applied to a bottom portion (first support portion supporting the element substrate) of the recessed portion 14, and a TAB-sticking adhesive 7 is applied to a portion for supporting the electrical wiring substrate 3 of the support member 4 (wiring substrate support portion, third support portion). The sealant 5 before curing is then applied to the top portion (holding portion) of the projected portion 16.

Thereafter, the element substrate 2 is arranged at a predetermined position of the recessed portion 14 and fixed with the mount adhesive 6, and so the liquid flow path 15 communicates with the liquid supply path of the element substrate 2. The electrical wiring substrate 3 is arranged on the wiring substrate support portion of the support member 4 and fixed with the TAB-sticking adhesive 7. The lead wire 8 is then embedded in the liquid sealant 5.

The mount adhesive 6 and the TAB-sticking adhesive 7 are favorably adhesives with good resistance to liquid, and for example, ultraviolet curable adhesives containing an epoxy resin as a main component may be used. The mount adhesive 6 is desirably applied so as not to form a space between the bottom portion of the recessed portion 14 and the element substrate 2.

The sealant 5 before curing is finally cured to complete the production of the liquid ejection head 1.

The first and second embodiments of the present invention will hereinafter be described in detail with reference to FIG. 2 to FIG. 5D.

First Embodiment

The first embodiments of the present invention will hereinafter be described with reference to FIG. 2 to FIG. 4B.

Figure 2:
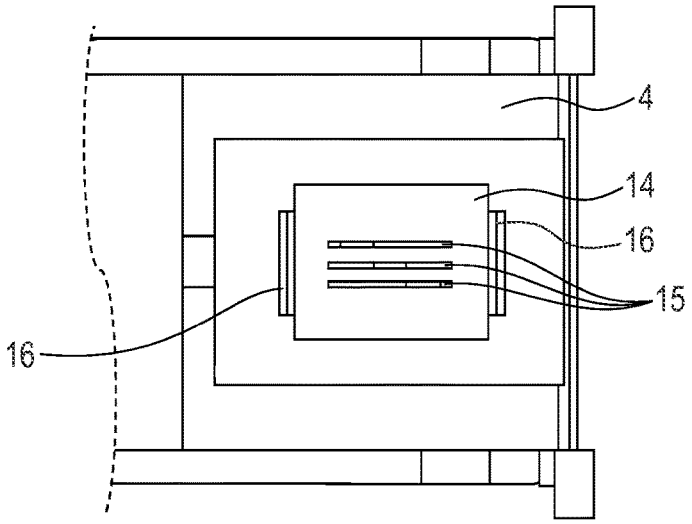
FIG. 2 is a partially enlarged front view of a support member in a first embodiment.

FIG. 2 is a partially enlarged front view of a support member 4 in this embodiment. The support member 4 has a recessed portion 14 for supporting and fixing an element substrate 2 and a liquid flow path 15 for supplying a liquid to a liquid supply path of the element substrate 2. The recessed portion 14 and the liquid flow path 15 are formed in one member.

As a material for forming the support member 4, a wide variety of materials such as a resin material and a ceramic material typified by $Al_2O_3$ may be used. In this embodiment, the support member 4 is formed with modified poly(phenylene ether) (PPE).

Figure 3A:
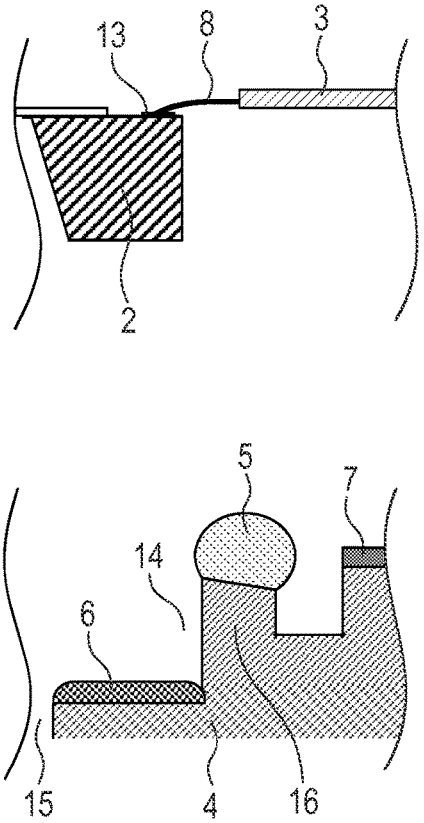
FIGS. 3A and 3B are sectional views for explaining a production process according to the first embodiment.
Figure 3B:
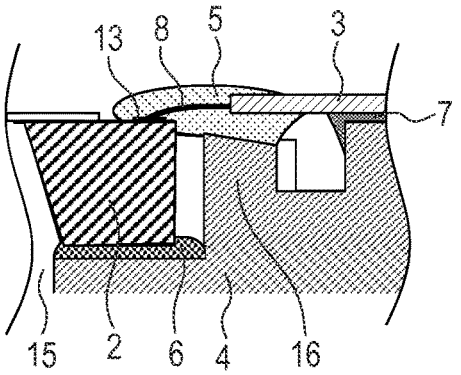

FIGS. 3A and 3B are drawings for explaining a production process according to this embodiment and enlarged sectional views taken along line 3-3 in FIG. 1B and illustrating the element substrate 2, the electrical wiring substrate 3 and the support member 4.

As illustrated in FIG. 3A, the element substrate 2 is first electrically connected to the electrical wiring substrate 3 through a lead wire 8. For example, a gang bonding method may be used for the connection of the element substrate 2 to the electrical wiring substrate 3. In addition, a mount adhesive 6 is applied to a bottom surface of the recessed portion 14, and a TAB-sticking adhesive 7 is applied to a wiring substrate support portion. Further, a liquid sealant 5 is applied to a tip surface of a projected portion 16.

The sealant 5 before curing is applied to the tip surface of the projected portion 16, whereby a meniscus is formed on the surface of the sealant 5 before curing to stabilize the height of the sealant 5. A material having a relatively high viscosity is favorably used as the sealant 5 for more heightening the height of the sealant 5 before curing.

The tip surface of the projected portion 16 is desirably inclined to a side opposite to the side of the opening of the liquid flow path 15 with respect to the bottom surface of the recessed portion 14 (element substrate support surface). The tip surface of the projected portion 16 is inclined in this manner, whereby the sealant 5 before curing applied to the tip surface of the projected portion 16 does not easily flow toward the opening of the liquid flow path 15. As a result, the liquid flow path 15 is not easily closed by the sealant 5.

As illustrated in FIG. 3B, the element substrate 2 and the electrical wiring substrate 3 are then arranged on the support member 4. At this time, the lead wire 8 is embedded in the sealant 5 before curing. The lead wire 8 is embedded in the sealant 5 before curing, whereby the sealant 5 protrudes from a side opposite to the side of the projected portion 16 of the lead wire 8 (hereinafter, referred to "front side of the lead wire 8").

Thereafter, the sealant 5 before curing is cured, thereby forming the sealant 5 covering the lead wire 8.

The amount of the sealant 5 before curing applied to the tip surface of the projected portion 16 is desirably an amount required for the sealant 5 to sufficiently protrude from the front side of the lead wire 8 when the element substrate 2 and the electrical wiring substrate 3 are arranged on the support member 4. The sufficient amount of the sealant 5 is applied to the tip surface of the projected portion 16, whereby the lead wire 8 is easily embedded in the sealant 5.

When the tip surface which is a top surface of the projected portion 16 is used as the support surface supporting the sealant 5, a space between the support surface supporting the sealant 5 and the lead wire 8 becomes narrower. As a result, the lead wire 8 can be covered with the sealant 5 even when the amount of the sealant 5 before curing is relatively small. The sealant is applied in this manner, whereby a space portion to which the sealant is not applied is formed between the projected portion 16 and the element substrate 2. In addition, a space portion to which neither the sealant nor the adhesive is applied is formed between the projected portion 16 and the third support portion to which the adhesive 7 is applied. Such a space portion can be caused to function as a portion receiving the adhesive when the adhesive 7 protrudes from between the electrical wiring substrate and the third support portion. In addition, contact of the sealant 5 with the adhesive 7 can also be inhibited.

Figure 4A:
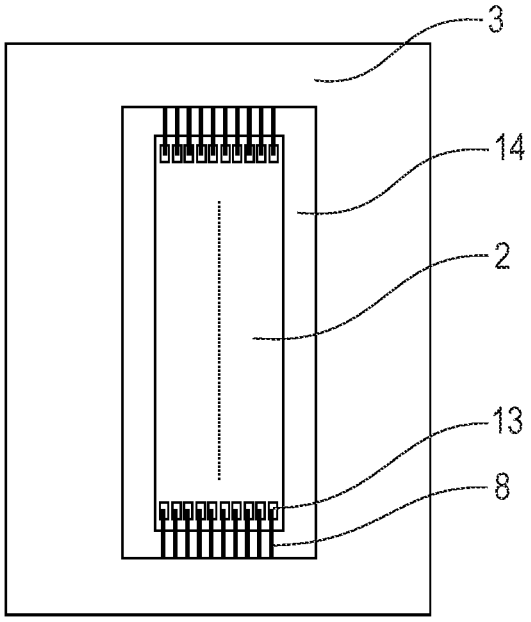
FIGS. 4A and 4B are front views illustrating a liquid ejection head before and after a sealant passes through a space between adjoining lead wires.
Figure 4B:
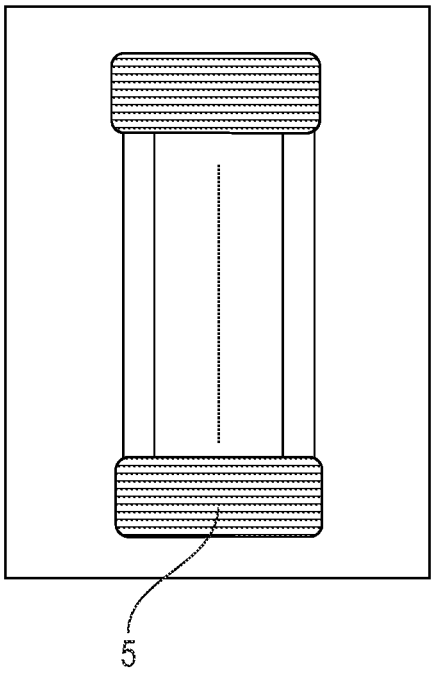

When the element substrate 2 is connected to the electrical wiring substrate 3 through a plurality of lead wires 8, the sealant 5 passes through a space between adjoining lead wires 8. FIGS. 4A and 4B are plan views illustrating the liquid ejection head 1 before and after the sealant 5 passes through the space between the adjoining lead wires 8.

The easiness of the sealant 5 before curing to pass through the space between the adjoining lead wires 8 is determined by the thickness of each lead wire 8, the distance between the adjoining lead wires 8 (hereinafter, referred to as "lead wire distance") and the viscosity of the sealant 5 before curing. The sealant 5 before curing more easily passes through the space between the adjoining lead wires 8 and to cover the lead wires 8, as the thickness of the lead wire 8 is smaller and the lead wire distance is larger.

In this embodiment, the thickness of the lead wire 8 was controlled to 40 μm, and the lead wire distance was controlled to 80 μm. A thermally curable resin having a viscosity of 20 Pa·s or more and 250 Pa·s or less (as measured under conditions of 20° C., 10 revolutions and 20 rpm with a No. 7 rotor of a B8H type viscometer) and containing an epoxy resin as a main component was used as the sealant 5 before curing, and heat was applied to the sealant 5 to cure the sealant 5.

The production process according to the present invention does not require a step of leaving the support member 4 to stand after the sealant 5 before curing is applied to the tip surface of the projected portion 16. In addition, the step of applying the sealant 5 before curing may be conducted only once. Accordingly, the production time can be shortened.

In particular, in the production process in which the support member 4 has to be left to stand for a certain period of time after the sealant 5 before curing is applied to or poured into the predetermined region (the production process disclosed in Japanese Patent Application Laid-Open No. 2001-130001), the production apparatus requires a space for leaving the support member 4 to stand. As a result, it is necessary to enlarge the production apparatus.

According to this embodiment, there is no need to leave the support member 5 to stand after the sealant 5 before curing is applied to the tip surface of the projected portion 16. Accordingly, it is not necessary to provide the space for leaving the support member 4 to stand in the production apparatus, and so the production apparatus can be miniaturized.

In addition, according to this embodiment, only one kind of sealant 5 is used, so that the management of materials upon the production of the liquid ejection head 1 becomes relatively easy, and the work upon the production can be simplified.

According to this embodiment of the present invention, the production time of the liquid ejection head can be shortened, and the work upon the production of the liquid ejection head can be more simplified.

Second Embodiment

The second embodiment of the present invention is described with reference to FIGS. 5A to 5D.

FIGS. 5A to 5D are drawings for explaining a production process according to this embodiment and enlarged sectional views taken along line 3-3 in FIG. 1B and illustrating the element substrate 2, the electrical wiring substrate 3 and the support member 4. The support member 4 includes the recessed portion 14 and the projected portion 16 like the first embodiment and is formed with the modified PPE.

In this embodiment, an ultraviolet curable resin containing an epoxy resin as a main component is used as the sealant 5. The sealant 5 is more favorably an ultraviolet delayed-curable resin. The ultraviolet delayed-curable resin is a resin which initiates a curing reaction by applying ultraviolet light thereto and takes about several minutes to several tens minutes for curing.

Figure 5A:
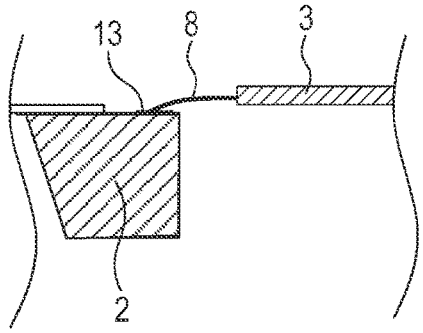
FIGS. 5A, 5B, 5C and 5D are sectional views for explaining a production process according to a second embodiment.
Figure 5A:
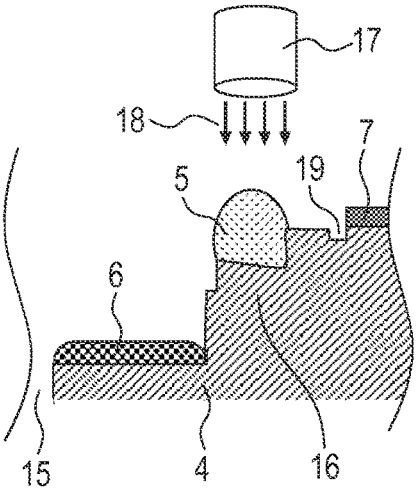

As illustrated in FIG. 5A, the element substrate 2 is first electrically connected to the electrical wiring substrate 3 through a lead wire 8. For example, a gang bonding method may be used for the connection of the element substrate 2 to the electrical wiring substrate 3. In addition, a mount adhesive 6 is applied to a bottom surface of the recessed portion 14 (element substrate support surface), and a TAB-sticking adhesive 7 is applied to a wiring substrate support portion.

Further, the sealant 5 before curing is applied to a tip surface of the projected portion 16. The amount of the sealant 5 before curing applied to the tip surface of the projected portion 16 is an amount required for the sealant 5 to protrude from a side opposite to the side of the projected portion 16 of the lead wire 8 when the element substrate 2 and the electrical wiring substrate 3 are arranged on the support member 4.

The tip surface of the projected portion 16 is inclined like the first embodiment in such a manner that the liquid sealant 5 does not flow into the liquid flow path 15. In addition, a groove 19 is formed between the projected portion 16 and an opening edge of the recessed portion 14 (wiring substrate support portion) in such a manner that the liquid sealant 5 does not flow into the wiring substrate support portion.

After the sealant 5 before curing is applied to the tip surface of the projected portion 16, ultraviolet light 18 emitted from an ultraviolet light source 17 is applied to the sealant 5 before curing. Since the sealant 5 is the ultraviolet delayed-curable resin, the sealant 5 is not yet cured just after the ultraviolet light 18 is applied.

Figure 5B:
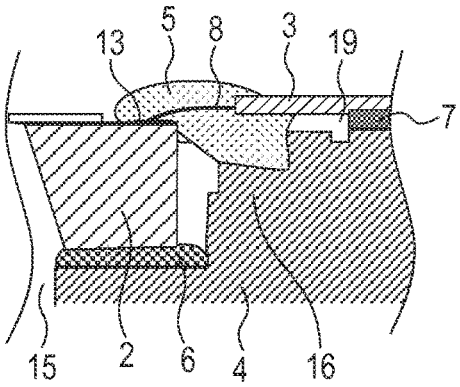

After the ultraviolet light 18 is applied to the sealant 5 before curing, the element substrate 2 and the electrical wiring substrate 3 are arranged on the support member 4 as illustrated in FIG. 5B. Since the sealant 5 is not yet cured at this time, the lead wire 8 is embedded in the sealant 5.

Thereafter, the sealant 5 is cured to form the sealant 5 covering the lead wire 8.

In this embodiment, the sealant 5 is the ultraviolet delayed-curable resin, so that there is no need to heat the sealant 5. In order to cure the sealant 5 in a shorter period of time, heat may also be applied to the sealant 5 before curing after the lead wire 8 is embedded in the sealant 5 before curing.

Figure 5C:
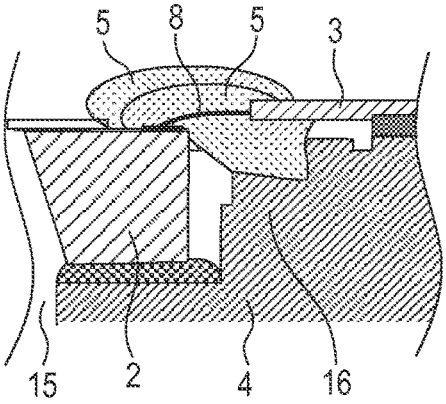
Figure 5D:
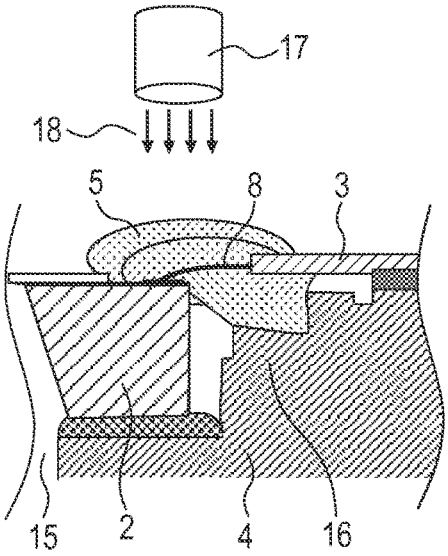

The lead wire 8 is protected even in the state illustrated in FIG. 5B. However, a new sealant 5 may also be additionally applied on to the sealant 5 having been applied to the tip surface of the projected portion 16 as illustrated in FIG. 5C. When the sealant 5 is additionally applied in this manner, the whole thickness of the sealant 5 is increased to improve the resistance to liquid of the sealant 5, so that the lead wire 8 can be more surely protected. As a result, short circuit does not easily occur. When the new sealant 5 is applied, it is necessary to additionally apply the ultraviolet light 18 as illustrated in FIG. 5D.

According to this embodiment, the same effect as the first embodiment is achieved, and moreover there is no need to provide a furnace for applying heat to the sealant 5, so that the production apparatus can be more miniaturized.

According to this embodiment, the ultraviolet light 18 is applied to the sealant 5 in the state illustrated in FIG. 5A, that is, the state where neither the element substrate 2 nor the electrical wiring substrate 3 is arranged on the support member 4 and the lead wire 8 is not embedded in the sealant 5 before curing. Accordingly, the ultraviolet light 18 can be applied to the whole of the sealant 5 before curing without forming the shadows of the element substrate 2, the electrical wiring substrate 3 or the lead wire 8 on the sealant 5. As a result, the sealant 5 can be uniformly cured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-071974, filed Mar. 29, 2013, which is hereby incorporated by reference herein in its entirety.

What is claimed is:

1. A process for producing a liquid ejection head, comprising:

a first step of providing an element substrate including an element for generating energy to be utilized for ejecting a liquid, a wiring substrate electrically connected to the element substrate by a lead wire, and a support member including a first support portion and a second support portion which includes a tip surface of a projected portion projected with respect to the first support portion;

a second step of applying a sealant to the tip surface of the second support portion, the second step being performed after the first step;

a third step of placing the element substrate on the first support portion to which an adhesive is applied and embedding the lead wire in the sealant applied to the tip surface of the second support portion, the third step being performed after the second step; and a fourth step of curing the sealant in which the lead wire is embedded, the fourth step being performed after the third step.

2. The process according to claim 1, wherein the sealant is a thermally curable material, and in the fourth step of curing the sealant, the sealant is cured by applying heat to the sealant before complete curing.

3. The process according to claim 1, wherein the adhesive is applied to the first support portion before the element substrate is placed on the first support portion.

4. The process according to claim 3, wherein the sealant and the adhesive are thermally curable materials.

5. The process according to claim 4, wherein the sealant and the adhesive are cured by placing the liquid ejection head into a heated atmosphere.

6. The process according to claim 1, wherein the second support portion is inclined with respect to the first support portion.

* * * * *